United States Patent [19]

Prodi et al.

[11] Patent Number: 5,056,724

[45] Date of Patent: Oct. 15, 1991

[54] PROCESS AND APPARATUS FOR CONTROLLING DISTRIBUTION OF THREAD ON A PACKAGE IN A COLLECTION UNIT FOR SYNTHETIC THREADS

[75] Inventors: Paolo Prodi, Ravenna; Adriano Albonetti, Forlí, both of Italy

[73] Assignee: Savio S.p.A., Pordenone, Italy

[21] Appl. No.: 455,755

[22] Filed: Dec. 22, 1989

[30] Foreign Application Priority Data

Dec. 23, 1988 [IT] Italy ..... 23104 A/88

[51] Int. Cl.[5] ..... B65H 54/38

[52] U.S. Cl. ..... 242/18.1

[58] Field of Search ..... 242/18.1

[56] References Cited

U.S. PATENT DOCUMENTS

| | | | |
|---|---|---|---|
| 4,504,021 | 3/1985 | Schippers et al. | 242/18.1 |
| 4,504,024 | 3/1985 | Gerhartz | 242/18.1 |
| 4,515,320 | 5/1985 | Slavik et al. | 242/18.1 X |
| 4,667,889 | 5/1987 | Gerhartz | 242/18.1 |
| 4,676,441 | 6/1987 | Maag | 242/18.1 |
| 4,697,753 | 10/1987 | Schippers et al. | 242/18.1 |
| 4,771,961 | 9/1988 | Sugioka | 242/18.1 |
| 4,779,813 | 10/1988 | Sugioka et al. | 242/18.1 |

FOREIGN PATENT DOCUMENTS

| | | |
|---|---|---|
| 248406 | 12/1987 | European Pat. Off. . |
| 260682 | 3/1988 | European Pat. Off. . |
| 2127443 | 4/1984 | United Kingdom . |
| 2167454 | 5/1986 | United Kingdom . |

*Primary Examiner*—Stanley N. Gilreath

*Attorney, Agent, or Firm*—Hedman, Gibson, Costigan & Hoare

[57] ABSTRACT

The present invention relates to a process for piloting the distribution of thread on a package under formation, in a collection unit for collecting synthetic threads, to prevent ribboning from forming during the continuous overlapping of different winding layers. The present invention further relates to an apparatus to implement the above process. The process comprises setting, instant by instant, values of operational parameters during the thread winding in such a way that the collection unit operates along descending portions of lines. Each line is defined by a constant and non-integer "winding ratio" "K". The line portions are contained inside a range bounded by a maximum threshold value and a minimum threshold value of the winding angle. The maximum and minimum threshold values are symmetrical to the optimum value. The process further relates to piloting a traverse cam to fix any dislocation of the descending line portions at a distance higher than, or at least equal to, a prefixed reference value.

3 Claims, 2 Drawing Sheets

PROCESS AND APPARATUS FOR CONTROLLING DISTRIBUTION OF THREAD ON A PACKAGE IN A COLLECTION UNIT FOR SYNTHETIC THREADS

FIELD OF THE INVENTION

The present invention relates to a process and apparatus for controlling the distribution of thread on a package under formation in a collection unit for synthetic threads.

More particularly, the apparatus comprises a control unit based on a minicomputer, to which the operational winding data are entered. After the winding data are processed and compared with data incoming from transducers, or from similar means, the minicomputer generates a plurality of control signals which enable and instantaneously control a motor source of the traverse cam. This control prevents any ribboning (which is regarded as detrimental), from being formed on the package under formation.

In the following disclosure and in the appended claims, the term "thread" or "filament" is understood to mean any types of thread-like materials. The term "package" or "bobbin" is understood to mean any made-up forms of said thread-like materials wound according to substantially helical turns.

BACKGROUND OF THE INVENTION

From the prior art a collection unit for synthetic threads is known, in which synthetic threads are collected at a constant speed during the winding of the package.

The collection unit is equipped with one or more package-carrier spindle(s), a feeler roller, or motor-driven roller, and a traversing unit cam which is provided with cross helical slots for driving a thread-guide slider.

It is well-known that the control of revolution speed of the spindle to secure a constant collection speed takes place by means of the feeler roller. This roller is kept in contact with the circumference of the packages during the winding of the thread and is preferably driven by means of a variable-frequency synchronous or asynchronous electrical motor.

The difference between the peripheral speed of the packages, (which tend to increase with increasing package diameters), and the peripheral speed of the feeler roller cause a rotation in the internal part of the feeler roller. The internal part is supported by bearings, so as to be capable of rotating. This rotation acts on a potentiometer. A signal of the potentiometer regulates the new necessary revolution speed for the package-carrier-spindle driving motor to regulate and keep constant the package collection speed.

With reference to the field of "precision winding", the problems are very important and concern imperfections of the made-up threads. These problems are directly related to the principle of distributing the thread on the package.

The collection units which are designed to produce packages of wound thread nearly always lead to the formation of deposits of turns which are concentrated in some points. These deposits lead to the problem of ribboning.

Ribboning appears as a winding defect. The thread, while wound in mutually overlapping turn layers, forms compact thread cord-like bands on the package.

Incidentally, in the following disclosure, this defect will be called "ribboning", or "taping", or "mirror effects", with these terms being used interchangeably. These ribboning defects appear during the winding when the ratio of the number of revolutions (during a unit of time) of the package to the number of to-and-fro (double) strokes (during the same time unit) of the traversing device (i.e., of the thread-guide slider) and is represented by an integer.

Under these conditions, after a double stroke is completed by the thread-guide, the starting point of the turns which comprise the new layer coincides with the starting point of the previous layer.

This causes overlapped, hardened thread layers which form the ribboning, and are in the form of maximum-density tapings. The formation of ribboning compromises the correct unwinding of the thread which will be later unwound. It can further compromise the uniformity of liquid passage during a process of dyeing the bobbins. This can result in layers which are not uniformly dyed, and therefore can result in changes in the thread dyeing level. In order to prevent these drawbacks, a divisional ratio should be selected, to give the turns a small, suitable and advantageous shift which is relative to the preceding turns.

For example, the revolution speed of the bobbin varies over time. The purpose of this speed variance is to keep constant the peripheral speed of the package as its diameter increases. In this way the number of complete strokes performed during the time unit by the thread-guide slider remains constant. In this example, the ratio of the number of revolutions "N" of the package during a certain time unit to the number of complete, to-and-fro, strokes "Z" of the thread-guide slider during the same time unit will vary from a maximum value at the beginning of bobbin winding, down to a minimum value when the bobbin is full. This is a continuous process. Therefore intermediate integer values, as well as exact fractional values (such as $\frac{1}{2}$, $\frac{1}{4}$, and so forth . . . ; as well as $n_1/2$, $n_1/3$, $n_1/4$ . . . , occur (incidentally, $n_1$ can be any integer relative to the denominator).

This ratio is defined hereinafter as the "winding ratio" ("K" value) of the package under formation. For each of said integer values, or of said exact fraction values, the formation of ribboning, i.e., the superimposition of a plurality of thread windings giving rise to the mirror effect, will occur.

Therefore, when the value of the winding ratio K passes through a value in the range of an integer or of an exact fraction value, tapings will be formed in the bobbin. The extent of said tapings is directly proportional to the amount of time the bobbin is wound within this range of values. The tapings which result reach their highest extent when the mirror effect is of the 1st order, i.e., when two layers superimpose upon one another with each winding having a "K" winding ratio of an integer value.

In an analogous way, mirror effects of the 2nd, 3rd, 4th order, and so on, occur when the thread is wound on the same point respectively after 2, 3, 4 and so forth . . . Layers, i.e., with a "K" winding ratio having an exact fractional value.

Therefore, the intensity of the phenomenon decreases with an increasing order of mirror effect.

From the above, the need arises to stagger the winding turns. In this way the time that the "K" ratio exists may be as short as possible to reduce the above mentioned mirror effects in the winding of the thread collection package.

The above described method distributing the thread on the package represents a "random" winding.

Another method of distributing the thread on the package comprises keeping a ratio of the number of revolutions "N" of the package (during a certain time unit), to the number of complete, to-and-fro strokes "Z" (during the same time unit) during which the thread-guide slider remains constant. When the peripheral speed of the package remains constant with an increasing winding diameter (that is, the thread collection speed remains constant), a continuous and gradual decrease in the number of revolutions of the spindle results. A constant thread collection speed further results in the simultaneous reduction in the number of complete strokes of the thread-guide slider. It is known that the cam which drives the thread-guide slider is itself driven by a variable frequency motor by means of an inverter.

The method of distributing the thread on the package according to this method represents a "precision" winding.

By means of such a distribution, the value of the winding ratio "K" remains constant. The value which is selected for the winding ratio "K" at the beginning of package winding should be a fractional number which is capable of giving each turn a shift relative to the preceding turn. For example, if the shift is small and approximately corresponds to the diameter of the thread, a compact bobbin is obtained. If on the contrary, the shift is considerably larger than the diameter of the thread, a porous winding is obtained. A porous winding would be particularly suitable for a following dyeing process.

In light of the above, the thread collection should occur under conditions which would avoid the values which cause ribboning problems. Therefore thread should be wound with an uniform distribution of turns on the circumference of the package under formation. However, "precision winding" has considerable disadvantages which render it unsuitable for larger package diameters which are presently used. For example, as a result of the decrease in the reciprocating speed of the thread-guide, the collection speed decreases with an increasing package diameter. This causes negative effects on the constancy of the count of the wound thread. Furthermore, an excess difference occurs between the initial winding angle and the final winding angle of the last thread layer on the package.

The winding angle is the angle at which the thread winding meets perpendicular to the axis of the package. The stability of the thread package depends on this angle. In fact, an excessive initial winding angle causes a slipping of the thread layers. Too small of a winding angle at the end of winding causes the formation of side bulges due to poor mutual cohesion of the thread layers.

The compactness of the package also depends upon the winding angle. In fact, the more that the turns are cross-wound, the greater the winding angle, the lower the packing density of the threads, and the greater the softness of the package. The smaller the winding angle, the more compact the package. It is evident that during winding the thread on the package, the winding angle should remain constant, or, at most, undergo a small variation around the value that was selected as the optimum value of the package. An excessive variation of the winding angle causes changes in compactness within the interior of a package. A variation in the compactness of the package renders it difficult to be used during subsequent steps in the manufacturing process.

Several techniques have been proposed and are used in the prior art to improve the characteristics of a package under formation in a collection unit for the high-speed collection of synthetic threads.

For example, a device is used in collection units which use the random type of winding which staggers the thread-guide slider stokes (the traversing device strokes) by means of an electronic system. This system is installed on an inverter which changes the frequency of the motor means actuating the traversing device cam.

Therefore, by means of such a device, modulation is introduced into the frequency of revolution of the cam. A modulation is consequently introduced of the frequency of the strokes of the thread-guide slider. In such a way, the dwell time of winding under conditions of integer-number of exact-fraction (such as $\frac{1}{2}$, $\frac{1}{4}$, etc...) "K" winding ratios, which cause ribboning, is decreased.

As a result, the ribboning effects remain, but the length of time during which the winding remains under those critical winding conditions decrease. However reduced though, the problem of overlapping of the wound thread remains. The above-described device merely reduces the occurrences of the phenomenon of ribboning. Such a device, although widely used, suffers from a serious drawback. That is, the attenuation of the ribboning (the mirror effect) is not constant, because its effect varies with the varying size of the package under formation.

Another different device which is suggested by the prior art to prevent the wound thread from superimposing upon one another, is based on forming the package with a succession of precision windings. These precision windings have constant, fractional values of the "K" ratio. The line portions have all the same length, and follow one another according to a decreasing-"K" order. They are united by substantially vertical portions which are obtained by means of a rapid increase in the frequency of the revolution of the thread-guide slider cam. This device results in a considerable improvement in the quality and characteristics of a package under formation having cross-wound turns.

Despite this improvement, from time to time faults of layers or thread positions occur in the cross-wound package. In fact, this device, even if it improves the distribution of the elementary layers of threads wound on the package does not ensure that portions of precision winding along which the collection unit operates, are spaced apart from a line having an integer "K" value, or with an exact-fraction "K" value, by a long enough distance.

Logically, when such closeness occurs, the thread is wound with a higher compactness. This winding can result in a ribboning, however faint, which will cause difficulties during the unwinding step during subsequent processing. The package which will be formed will therefore have, even in the best case, winding layers of varying degrees of compactness. This will impede the passage of liquid during a subsequent dyeing step. This passage of the dye will not be uniform, and the layers will be dyed in a non-homogeneous way.

These and other devices which are proposed in the prior art to ensure proper distribution of thread on the package have all resulted in an often uncertain operation. In fact, they have all resulted in varying degrees of ribboning and a winding which is not always repeatably within the desired quality level.

A purpose of the present invention is to eliminate the above said drawbacks by providing an automatic process and an apparatus which yields a faultless result. The invention will be reliable in the reproducibility of the quality of the winding to yield a uniform thread distribution along both the width and depth of the package, when packages of any size are formed.

Another purpose of the present invention is to wind the packages so that they have homogeneous compactness, or homogeneous softness, in all points of the package under formation to thereby render it perfectly permeable for the dyeing liquids.

A further purpose of the present invention is to maintain the collection speed within a limited range of values so that synthetic threads are wound without undergoing overstresses which would be capable of deforming the long elastic chains of the polymers and to preserve their physical properties.

These and still further purposes are all achieved by means of the process according to the present invention. This invention makes possible the values of the winding parameters to be constantly entered so that the collection unit operates along descending line portions. Each line portion is the locus of points having constant, non-integer and non-exact-fractional value of the "K" winding ratio. These ratios make possible that the line portions are contained within a range which is bounded by a maximum limit value and a minimum limit value of the winding angle. The maximum limit value and the minimum limit value are symmetrical to the value which is regarded as the optimum value for the package under formation. The minimum and maximum values can be about 5% higher and 5% lower than the optimum value. These values allow the traversing device cam to be controlled to fix the dislocation of the descending line portions at a distance longer than, or, at least, equal to , a reference value from a line belonging to those lines having integer or exact-fraction "K" values. These represent the orders of ribboning of the "mirror effect" which are considered to be harmful to the quality of the winding. The reference value is fixed and preset at a value not greater than, half the distance between the two nearest adjacent lines which belong to those having integer or exact-fraction "K" values.

SUMMARY OF THE INVENTION

The apparatus used to implement the process according to the present invention is equipped with a control unit based on a minicomputer. Values of the winding parameters are entered into the control unit from a control keyboard. Values of ribboning which are regarded as harmful to the package are also entered into the minicomputer processing central unit, and are processed for the computerized definition of the collection of lines. Each of the lines has a constant, integer or exact-fraction value of "K" winding ratio. Signals arrive at the minicomputer which are generated at each revolution, or at each submultiple of revolution, of the traversing device cam shaft and of the package-carrier spindle. These signals are sent by transducers, as known from the prior art. The transducers are used to constantly supply the values of the revolution of the shafts. These values are then compared in an electrical comparator of the minicomputer to the set winding parameters to generate a plurality of continuous control signals. The continuous control signals switch on and control the motor which drives said traversing device cam. This motor is controlled so that the collection unit may operate with the parameters prearranged along the line portions. Each of the line portions is kept at a constant, non-integer or fractional value of the winding ratio "K". These values are such that they do not cause ribboning from forming and the line portions must be within the range comprising the maximum value and the minimum value of the winding angle. The line portions must also be at a distance longer than, or at least equal to, a prefixed reference value, and from a line belonging to the collection of lines having an integer, or exact-fraction, "K" values as processed by the computing center of the minicomputer.

A practical embodiment of the apparatus of the present invention is installed on each collection unit for winding synthetic threads on one or more packages.

BRIEF DESCRIPTION OF THE DRAWINGS

The present invention will be disclosed in detail on the basis of the examples of practical embodiments which are schematically represented in the hereto attached drawing sheets. These drawings illustrate the characteristics of the invention. It is to be understood that all of the hereto attached drawings, as well as their description, correspond to a preferred form of practical embodiment of the invention.

In the figures elements which perform the same functions are referred to by means of same reference numerals. Furthermore, for the sake of clearness the parts not necessary for the understanding of the invention are omitted, or are shown in a general way, because they are known.

DETAILED DESCRIPTION OF THE INVENTION

Figure 1:
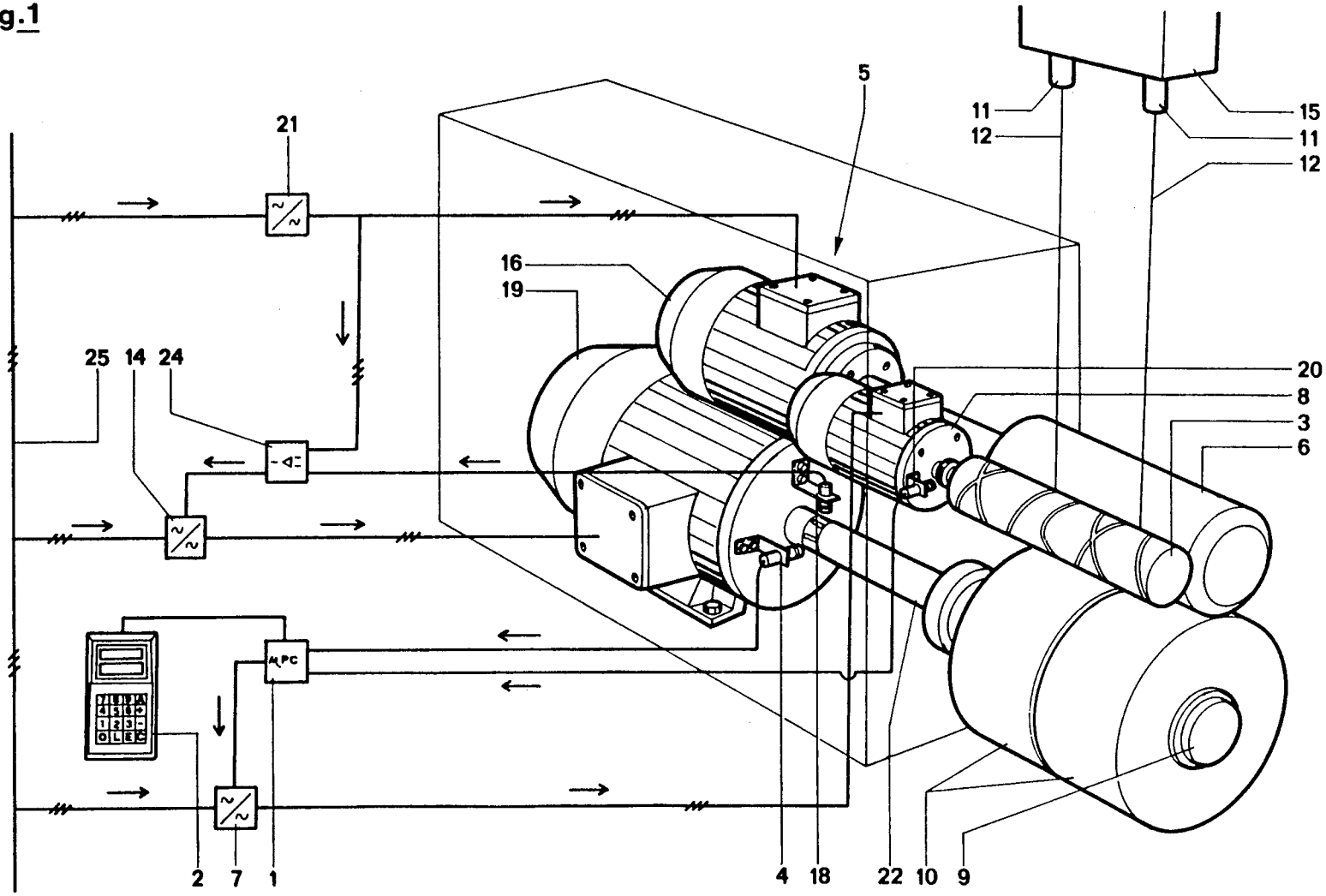
FIG. 1 is an orthogonal schematic view of a collection unit for synthetic threads. On the spindle are two packages under formation. The functional electrical connections between the transducers which determine angular position of the shafts, the control unit, and the means for controlling and actuating the driving the correct distribution of the thread on both of the packages under formation are schematically illustrated.

In the hereto attached figures:

5 indicates the collection unit which is the self-supporting box-like parallelepipedon. In the interior of the collection unit, the motion-source drive units and the control and pilot centres which control and pilot the operating elements of said collection unite are housed.

Element 12 is the thread, or filament, coming from an outlet 11 of the spinning apparatus 15 and through the traversing device 3. It is wound as a bobbin 10 slides on a spindle 9.

Element 3 is a cylindrical traversing device cam provided with cross helical slots driven by an asynchronous motor 8 and fed with a variable frequency through the inverter 7.

Element 15 is the end portion of the spinning apparatus, from which through the appendices 11 and the filaments 12 leave said spinning apparatus.

Element 6 is the feeler, or contact, motor-driven roller, having the purpose of checking the revolution speed of the bobbin-carrier, or package-carrier, spindle, in order to keep uniform the collection speed of the filament on the package under formation.

Said motor-driven feeler roller 6 revolves under constant contact with the package, or with the plurality of packages, and is driven by a synchronous, or asynchronous motor. The motor is fed with a constant frequency by means of an inverter 21, and also sometimes associated with a control encoder in such a way that the peripheral speed is rigidly constant and controlled and piloted by said inverter 21.

Element 16 is the motion source driving the motor-driven roller 6, preferably a synchronous or asynchronous motor. The motor 16 is fastened onto a saddle (not shown here, in that it is known from the prior art), which moves upwards along guide rails as the diameter of the package increases. By means of mechanical counterweighing which is fastened to said saddle, a proper pressure is maintained between the motor-driven roller and the package under formation.

Element 9 is the package-carrier spindle, which performs the function of collecting the produced filament, whose peripheral winding speed must be constant. Consequently as the diameter of the package or bobbin increases, the revolution speed of the spindle must decrease. In order to accomplish the above, the spindle is driven by an asynchronous motor 19 which is fed with a frequency which can be regulated by means of an inverter 14. It can also be driven by a d.c. motor, whose revolution speed is regulated by means of an inverter or d.c. actuators, which receive the control from the speed-control electronic means. Alternatively, it can be driven by means of a controllable-speed motor. Said speed control means are required to accomplish suitable speeds for the winding and the minimum power exchange between the motor-driven roller and the spindle. In particular, said speed control means are suitable for controlling both the motor-driven roller and the collection spindle at variable or constant speeds.

Elements 10 are the packages under formation. There may be more than one, after each other.

Element 1 is the control unit, which is based on a minicomputer. It is suitable for storing the information entered by the operator through a keyboard 2, and capable of converting said information into a program suitable for being executed by its computing and processing centre to supply digital and graphic results which are needed during the winding work.

Said digital and graphic results are memorized in the storage of said control unit which governs the whole apparatus according to the present invention.

Said control unit comprises a microprocessor. Information which is obtained from a system of sensors is fed into the unit (1) as input, and signals of operating modification, are produced as output through the inverter 7, to modify the operating conditions of the motion source 8. The motor (8) drives the cylindrical traversing device cam 3 to control the distribution of the threads 12 on the packages 10 under formation to prevent consecutive winding layers from overlapping each other.

Element 25 is the main, three-phase electrical line from which the leads branch and feed the inverters 7, 14 and 21.

Element 24 is a control and regulation block which, through the inverter 14, modifies the revolution speed of the spindle 9 to maintain a uniform speed of thread collection on the package as the package increases in diameter.

Element 4 is a detecting probe, or a proximity sensor, which is known from the prior art. By acting as a transducer, it generates outlet signals which are proportional to the revolution speed of a motor-driven shaft 22 of the packagecarrier spindle 9.

Said outlet signals come to, and are the input signals of, the pilot unit 1.

Element 20 is a detecting probe, or a proximity sensor, which is known from the prior art. By acting as a transducer, it generates outlet signals which are proportional to the revolution speed of the cylindrical traversing device cam 3.

Said outlet signals come to, and are the input signals of, the pilot unit 1.

Element 18 is a detecting probe, or a proximity sensor, which is known from the prior art. By acting as a transducer, it generates outlet signals which are proportional to the revolution speed of the motor-driven shaft 22 of the packagecarrier spindle 9. Said outlet signals come to the control and regulation block 24.

Figure 2:
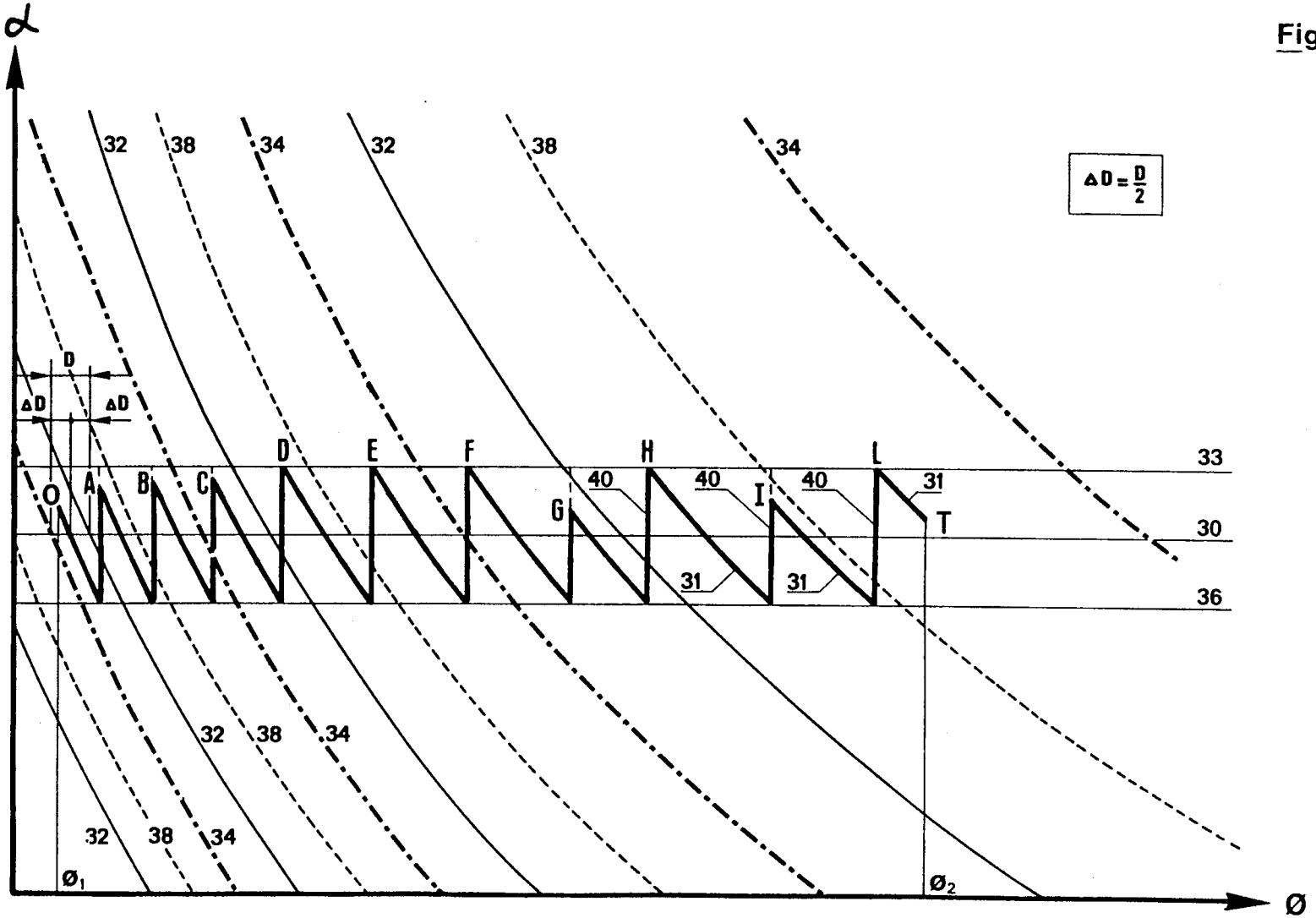
FIG. 2 is a chart with lines having a constant, integer or exact-fraction value of "K" showing the winding ratios and the working line portions. Each of these lines has a constant "K" value so as not to form ribboning. The working line portions of the collection unit are bounded by the lines of the maximum winding angle and of the minimum winding angle.

In FIG. 2, line 30 is a horizontal line corresponding to the optimum winding angle for the package under formation. Lines 33 and 35 are the horizontal lines which respectively correspond to the maximum value and to the minimum value of the winding angle which can be accepted during the winding operation for package 10 formation. Said maximum and minimum winding angles are substantially equal to the optimum winding angle (represented by the line 30) plus and minus 5%. Said maximum and minimum values which are comprised within the restricted limit of plus or minus 5% will not represent any error within the quality of the windings for package formation. On the basis of experimental tests which were carried out by the Applicant, said variations are capable of preserving the optimum winding properties, and of maintaining the best dyeing characteristics. This is due to the uniform compactness of the winding layers throughout the package 10. Lines 32 are the lines with constant and integer "K" winding ratio. The lines (32) represent the locus of the operating points of the collection unit in correspondence of which ribboning, or mirror effects of the first order will be formed. Therefore, this represents the worst example of overlapping of the windings, well known by those skilled in the art. Inasmuch as the winding ration "K" is defined by the ratio of the number of revolutions of the package to the number of the complete, to-and-from cycles of the threadguide slider, both being measured during the same time unit, one can easily understand that the constant-"K" lines decrease in value from the beginning of the package-forming winding to the winding end. This is because the final diameter of the package has been reached.

Lines 34 represent lines having constant, exact-fraction "K" value. These lines represent the locus of the operating points of the collection unit which corresponds with the formation of ribboning of the second order.

Lines 38 represent lines having constant, exact-fraction "K" value. These lines represent the locus of the operating points of the collection unit which corresponds with the formation of ribboning of the third order.

In order to better clarify these first, second, third, and successive orders of ribboning on the package it is known from the relevant technical literature, that:

ribboning of the first order will be formed in correspondence with values of a "K" winding ratio of, e.g.,: 7, 6, 6, 4, 3, 2, 1;

ribboning of the second order will be formed in correspondence with values of a "K" winding ratio of, e.g, n/2, wherein "n" can have values of: 13, 11, 9, 7, 5, 3, 1; and ribboning of the third order will be formed in correspondence with values of a "K" winding ratio of, e.g., n/4, wherein "n" can assume values of: 17, 13, 9, 5, 1. This progression continues for successive orders of ribboning. The letter D is the distance between two adjacent lines. That is in the whole collection of lines, these lines which are nearest to one another. They represent lines having constant "K" values. They represent, as a whole, the orders or ribboning regarded as harmful to the quality of the winding being carried out for the formation of the package. The character $\Delta D$ is half of said D distance. The character $\phi$ is the value of the diameter of the package. This value increases during the winding, and is represented on the abscissa of the chart shown in FIG. 2. Character $\alpha$ represents the winding angle, or crossing angle. It is represented on the ordinate of the chart shown in FIG. 2. The character $\phi_1$ is the diameter of the tube, i.e., of the support of the spindle 9. The cross windings of filament 12 which come from the spinning apparatus 15 are collected upon this spindle (9). $\phi_2$ is the end diameter which the package 10 has to reach before being expelled from the spindle 9. Lines 31 are the collection unit working line portions along which the "K" winding ratio is of constant, non-integer, non-exact-fraction value. Line portions 31 represent the locus of the operating points of the collection unit which correspond with windings which follow each other on the package 10 so as not to form ribboning or mirror effects considered harmful to the quality level of the package. This is pre-established by the operator.

Said line portions 31 are bounded by the range comprised between the horizontal lines 33 and 35 which are symmetrically positioned on both sides of line 30. Line 30 represents, as hereinabove said, regarded as the optimum winding angle for the package under formation. The letter 0 represents the operating point of the beginning of the windings for forming the package 10. The letter T represents the end-winding operating point. At point 'T' the package 10 will have reached its end diameter $\phi_2$ as prefixed by the operator.

The following disclosure of the operation of the apparatus according to the present invention, will be made by referring to the above cited Figures. It relates to the elements of novelty, and therefore only considers the apparatus according to the present invention. Applicants' invention pilots and controls means which are designed to carry out the distribution of the thread on the package under formation, so that the windings will not superimpose upon each other. The present invention produces thread windings having uniform compactness. It should be understood that the devices and means which are known from the prior art will not constitute the subject-matter of the disclosure.

The operator first enables the apparatus according to the present invention. The apparatus guides the package so that it will be wound with continuous cross-windings of synthetic thread which is fed by the spinning apparatus 15. The synthetic thread comes out of the spinning apparatus 15 at a substantially constant speed.

Thereafter the apparatus according to the present invention, pilots the distribution of the thread on the package.

On the window display of the control keyboard 2, various requests will be displayed, either all at once, or one after the other. This is so that the operating parameters of the thread winding can be entered.

Said requests are displayed for the operator, so that he may enter the following values:

the speed of collection of the thread 12 leaving the spinning apparatus 15;

the value of the optimum winding angle for the thread package 10 under formation;

the length of the transversal stroke of the thread-guide slider which, by guiding and horizontally shifting the thread, deposits and distributes the thread along the package by forming helical turns;

the number of the revolutions of the cylindrical traversing device cam 3. This number is necessary so that the thread-guide slider may carry out a double stroke, i.e., a complete to-and-from stroke;

the ribboning orders regarded as harmful to the quality of the selected winding;

the optimum percentage variation of the winding angle $\alpha$;

the diameters of the tube on which the winding of the thread 12 begins, and of the package 10 at the end of its formation.

Said values will be entered by the operator into the control unit 1 through the control keyboard 2. The values will be processed in the computing centre of said control unit according to a previously stored program. Then the whole sheaf of lines having integer "K" values or exact-fraction "K" values which represent the ribboning orders regarded by the operator as harmful to the quality of the winding will be computed and stored together with the collection unit operating parameters.

On the window display of the control keyboard 2, the half-value "D/2" will be displayed. The value D/2 is the distance between two adjacent lines nearest to each other in the sheaf of lines having integer "K" values and exact-fraction "K" values.

After reading the "D/2" value, the operator will enter a value, through the control keyboard 2. This next value will comprise the minimum deviation, i.e., the minimum distance between the working line portions 31 and the lines 32, 34 and 38. Lines 32, 34 and 38 are the operating loci which are to be avoided. These loci are to be avoided because along these lines ribboning, regarded as harmful to the winding under progress will form.

After preliminarily entering these values, the attending operator will start up the collection unit. The motion source 16 will bring the motor-driven roller 6 up to its steady-state revolution speed which is its collecting speed. Once the motor-driven roller 6 reaches its steady-state revolution speed, the motion sources 19 and 8 will be started up simultaneously. The cylindrical traversing unit cam 3 will then rotate at a revolution speed which is computed by the pilot unit 1. Pilot unit 1 will perform the task of controlling said revolution speed and therefore of controlling the known speed of translation of the thread-guide. The package-carrier spindle 9 will then revolve at a steady-state revolution speed as established by the control and regulation block 24.

The control and regulation block 24, which is known from the prior art, receives the value of the frequency at which the motion source 15 rotates the motor-driven roller 6, as an input. Therefore, this represents the value of the revolution speed of roller 6. The block 24 sends as an output, a continuous succession of a reference voltage to the frequency inverter 14. Frequency inverter 14 converts the frequency and regulates the value of the frequency which is fed to the motion source 19. This is so that the peripheral revolution speed of the spindle may come to a steady-state value. This steady-state value is the same value as that of the peripheral revolution speed of the contact motor-driven roller 6.

When the perfect equality of said peripheral revolution speeds is reached, the peripheral contact between the spindle 9 and the motor-driven roller 6 will be enabled. Both of these elements will be in equi-directed revolution, as well known by those skilled in the art.

The control unit 1 of the apparatus processes the input data which comes from the detecting probes 4 and 20. In the internal programs of the control unit 1, by means of its microprocessor, outputs of frequency are fed through the inverter 7 to the motion source 8. This output controls the precise revolution speed of the cylindrical traversing device cam 3 so that the collection unit operates with the working parameters which correspond to the "0" point of the chart of FIG. 2.

At this point in time the filament which comes from the spinning apparatus 15, is placed onto the support tubes of the packages 10.

In order to better clarify the position of the "0" operating point at the beginning of winding, the following is pointed out. Since the control unit 1 contains the data which is initially entered by the operator by means of a program which is stored in its microprocessor, the control unit 1 computes the position of the "0" point so that the "0" point will be spaced apart from any of the above mentioned harmful lines by a certain distance. This distance is longer than, or at least equal to, the minimum deviation as established and entered by the operator as explained hereinabove. It is also entered so that it is contained between the horizontal lines 33 and 36.

From the "0" point, the first portion of descending operating line 31 begins (see FIG. 2). Along operating lines 31 the winding is carried out and regulated as a "precision winding" by the control unit. By using the input information sent by the detecting probes 4 and 20, control unit 1 regulates the speed of revolution of the cylindrical traversing device 3 through the inverter 7. The revolution speed is continually controlled and is constrained to the speed of revolution of the spindle 9. The revolution speed of the spindle 9 is continuously varying with the increasing diameter of the package 10 under formation. The precise purpose of this variation is to constantly maintain the "K" winding ratio during said line portion 31. When this line portion 31 intersects with the horizontal line 36, the control unit 1, via the inverter 7, instantaneously changes the frequency which is fed to the motion source 8. This increases of the revolution speed of the cylindrical traversing device cam 3 occurs as rapidly as possible. Incidentally, said rapid increase in revolution speed is graphically represented in FIG. 2 by the substantially vertical lines 40. The new operating point of winding of the collection unit will be graphically represented by the "A" point. Said "A" point has its position constrained by the precise rules as above expressed for the "0" point. Therefore, the control unit 1, shall perform the task of enabling all those control signals in order to have a precise, piloted actuation of the motion source 8. Such actuation results in having the whole set of operating portions of descending lines which begin at the points A, B, C, D, E, F, G, H, I, L and end on the line 36. All the above is shown in the chart of FIG. 2.

The operating line portions 31 following each other are united by substantially vertical line portions 40. The line portion 40 unite the end of a line portion 31 to the beginning of the immediately following line portion 31. Incidentally, the B, C, D, E, F, G, H, I, L operating points also have a position which is constrained to the precise rules as above expressed for the "0" point.

The last line portion 31 will end, still under the action of the control unit 1, at the point at which the final diameter of the package 10 is reached. When the final diameter is reached, the package is expelled from the spindle 9 so that the collection unit can carry out operations necessary for forming new packages of crossed windings of filaments 12.

By means of the apparatus according to the present invention, a process is herein disclosed which is capable of forming packages. These packages have thread windings having a perfect distribution and are free from ribboning. As aforementioned, ribboning is regarded as harmful during subsequent steps of the production process in the textile manufacturing industry. Since the herein disclosed apparatus does not have levers or mechanical means of a complex structure, even in the presence of very high collection speeds, the windings on the formed packages are free from any overlapping or "mirror" effects.

It is evident that the hereinabove disclosed is merely for exemplifying, non-limitative purposes. Variations and modifications thereof may be made without departing from the scope of protection of the invention.

We claim:

1. A process for winding thread from a spinning apparatus in sequential steps in a winding cycle onto a rotating spindle of a collection unit at a constant rate for forming a package, wherein the collection unit comprises a traversing device for reciprocatingly guiding the thread from the spinning apparatus along the longitudinal axis of the spindle, wherein the reciprocating speed of the traversing device decreases in proportion to the decrease in rotational speed of the spindle so that values of constant winding ratios are produced which define a series of operating lines and rapidly increasing the reciprocating speed of the traversing device at the end of each sequential step, wherein the process comprises:

a) setting operating parameter values of winding angles for controlling the traversing device so that ribboning is not produced on the package, wherein said operating parameter values comprise a minimum value, an optimum value, and a maximum value wherein said minimum value and said maximum value are equidistant from said optimum value;

b) determining critical winding ratios defining lines from said set operating parameters wherein said critical winding ratios form undesirable packages having ribboning and determining said critical winding ratio lines closest one another;

c) setting a reference value not greater than half the distance between said critical winding ratio lines closest one another;

d) controlling and continually regulating the reciprocating speed of the traversing unit so that during each sequential step of the winding cycle, said series of operating lines are spaced apart from said critical winding ratio lines a distance not less than said reference value;

e) instantaneously increasing the reciprocating speed of the traversing device at the end of each sequential step of the winding cycle when said winding angle reaches said minimum value.

2. The process of claim 1 further comprising setting said maximum value at about 5% greater than said optimum value and setting said minimum value at about 5% less than said optimum value.

3. A device for winding thread from a spinning apparatus in sequential steps in a winding cycle onto a rotating spindle of a collection unit at a constant rate for forming a package, wherein the collection unit comprises a means for rotating the spindle and a traversing device for guiding the thread from the spinning apparatus in reciprocating strokes to the rotating spindle in a winding ratio, wherein the winding ratio represents the ratio of the rotational speed of the package to two of the strokes of the traversing device, and wherein the winding ratio is constant during each step of the sequential steps of the winding cycle and the reciprocating speed of the traversing device increases at the end of each step of the sequential steps of the winding cycle; wherein the device comprises:

a) a control unit, wherein said control unit comprises:

(1) a process for calculating values for the winding ratios for the collection device and the reciprocating speed of the traversing device during each step of the sequential steps of the winding cycle;

(2) a data storage means for storing operating parameters of the device;, wherein said operating parameters comprise a reference value, a maximum winding angle, an optimum winding angle, and a minimum winding angle wherein said maximum winding angle and said minimum winding angle area equidistant from said optimum winding angle;

(3) a comparator means for comparing said calculated values with said operating parameters;

(4) a control signal generating means for generating control signals to the traversing device so that undesirable packages having ribboning are not formed, wherein said processor, said data storage means, said comparator means and said control signal generating means are all operatively interconnected to one another;

(b) a control keyboard operatively connected to said control unit for entering said operating parameters so that said processor of said control unit processes said operating parameters for determining critical winding ratios, wherein said critical winding ratios form undesirable packages having ribboning and for determining said critical winding ratios closest one another, and wherein said reference value represents a value not greater than half the difference between the closest of said critical winding ratios, so that when said reference value is entered by said control keyboard into said control unit said critical winding ratios are stored in said data storage means;

c) a first detecting means operatively connected to the package and to said control unit for continually detecting the rotational speed of the package and for sending first signals to said control unit;

d) a second detecting means operatively connected to the traversing device and to said control unit for continually detecting the reciprocating speed of the traversing device and for sending second signals to said control unit, so that when said control unit receives said first and second signals from said first and second detecting means respectively, said control unit compares said first and second signals with said values and said operating parameters stored in said data storage means by said comparator means, and said control signal generating means generates and send control signals for continually controlling the reciprocating speed of the traversing device so that during each step of the sequential steps of the winding cycle a constant winding ratio is maintained, wherein said constant winding ratio is separated from said critical winding ratio by not less than said reference value so that the reciprocating speed of the traversing device increases when the winding ratio reaches said minimum angle at the end of each step of the sequential steps of the winding cycle.

* * * * *